US010337830B2

(12) United States Patent
McHale et al.

(10) Patent No.: US 10,337,830 B2
(45) Date of Patent: Jul. 2, 2019

(54) PORTABLE OPTICAL DEVICE WITH INTERACTIVE WIRELESS REMOTE CAPABILITY

(71) Applicant: TrackingPoint, Inc., Austin, TX (US)

(72) Inventors: John Francis McHale, Austin, TX (US); Jason Peter Schauble, Austin, TX (US); John Hancock Lupher, Austin, TX (US)

(73) Assignee: Talon Precision Optics, LLC, Jacksonville, FL (US)

( * ) Notice: Subject to any disclaimer, the term of this patent is extended or adjusted under 35 U.S.C. 154(b) by 517 days.

(21) Appl. No.: 13/732,191

(22) Filed: Dec. 31, 2012

(65) Prior Publication Data

US 2014/0184788 A1 Jul. 3, 2014

(51) Int. Cl.

| | |
|---|---|
| ***F41G 1/38*** | (2006.01) |
| ***H04N 7/18*** | (2006.01) |
| ***F41G 3/16*** | (2006.01) |
| ***F41G 3/02*** | (2006.01) |
| ***F41G 3/04*** | (2006.01) |
| *F41G 3/06* | (2006.01) |
| *F41G 3/08* | (2006.01) |

(52) U.S. Cl.

CPC ..... *F41G 1/38* (2013.01); *F41G 3/02* (2013.01); *F41G 3/04* (2013.01); *F41G 3/165* (2013.01); *F41G 3/06* (2013.01); *F41G 3/08* (2013.01)

(58) Field of Classification Search

CPC ..... F41G 1/38; F41G 3/165; F41G 3/26

See application file for complete search history.

(56) References Cited

U.S. PATENT DOCUMENTS

| | | | | |
|---|---|---|---|---|
| 5,579,165 | A | 11/1996 | Michel et al. | |
| 6,899,539 | B1 * | 5/2005 | Stallman et al. | 434/11 |
| 7,255,035 | B2 * | 8/2007 | Mowers | 89/41.05 |
| 8,648,914 | B1 * | 2/2014 | Winker | F41G 3/145 244/3.16 |
| 8,678,282 | B1 * | 3/2014 | Black et al. | 235/417 |
| 2002/0197584 | A1 * | 12/2002 | Kendir et al. | 434/21 |
| 2006/0010697 | A1 * | 1/2006 | Sieracki et al. | 33/267 |
| 2007/0277421 | A1 * | 12/2007 | Perkins et al. | 42/122 |

(Continued)

FOREIGN PATENT DOCUMENTS

| | | |
|---|---|---|
| DE | 197 19 977 C1 | 10/1998 |
| EP | 1 693 639 A1 | 8/2006 |

(Continued)

OTHER PUBLICATIONS

Extended European Patent Office Search Report, Application No. 13199337.0-1811 / 2749836, dated Jun. 26, 2015.

*Primary Examiner* — Rebecca A Volentine

(74) *Attorney, Agent, or Firm* — Cesari & Reed, LLP; R. Michael Reed

(57) ABSTRACT

A firearm scope comprises an optical sensor to capture video data, a display, a transceiver configured to communicate data wirelessly through a communication channel, and a controller. The controller can be configured to provide a portion of the video data to the display, provide media content including the video data to the transceiver for wireless transmission, receive a signal from the communication channel in response to the wireless transmission, and selectively modify the portion of the video data to the display in response to receiving the signal.

21 Claims, 8 Drawing Sheets

(56) References Cited

U.S. PATENT DOCUMENTS

| | | | | |
|---|---|---|---|---|
| 2008/0020354 | A1* | 1/2008 | Goree | F41A 17/06 434/11 |
| 2008/0039962 | A1* | 2/2008 | McRae | F41A 17/06 700/90 |
| 2009/0111454 | A1* | 4/2009 | Jancic et al. | 455/420 |
| 2009/0200376 | A1* | 8/2009 | Peters et al. | 235/404 |
| 2009/0205239 | A1* | 8/2009 | Smith, III | 42/122 |
| 2010/0196859 | A1* | 8/2010 | Saugen | A42B 3/042 434/11 |
| 2011/0030545 | A1* | 2/2011 | Klein | 89/41.05 |
| 2011/0173869 | A1* | 7/2011 | Uhm | 42/111 |
| 2011/0241976 | A1* | 10/2011 | Boger et al. | 345/8 |
| 2012/0106170 | A1* | 5/2012 | Matthews et al. | 362/311.06 |
| 2014/0110482 | A1* | 4/2014 | Bay | F41G 1/38 235/404 |

FOREIGN PATENT DOCUMENTS

| | | | | |
|---|---|---|---|---|
| WO | 2012138242 | A1 | 8/2009 | |
| WO | WO 2012131548 | A1 * | 10/2012 | F41A 17/08 |

* cited by examiner

PORTABLE OPTICAL DEVICE WITH INTERACTIVE WIRELESS REMOTE CAPABILITY

FIELD

The present disclosure is generally related to portable optical devices, such as rifle scopes, telescopes, and binoculars.

BACKGROUND

Portable optical devices, such as rifle scopes and gun-mounted cameras, typically include buttons or other controls that allow the shooter to adjust parameters, such as image focus, zoom, and other parameters. Additionally, when a shooter is in the field, the shooter may be making adjustments based on a certain target, yet that target may not be the ideal target and such adjustments may not reflect the correct designated impact point, and so on. Because of the inability to see what the user/shooter sees, it makes it very difficult, if not at times impossible, for a companion or guide to assist out in the field. Furthermore, when a parent is attempting to teach his/her child to shoot or hunt, the process can be difficult and frustrating as the child tries to describe what he/she is seeing and the parent tries to understand and instruct the child.

SUMMARY

In an embodiment, a firearm scope includes an optical sensor to capture video data, a display, a transceiver configured to communicate data wirelessly through a communication channel, and a controller. The controller can be configured to provide a portion of the video data to the display, provide media content including the video data to the transceiver for wireless transmission, receive a signal from the communication channel in response to the wireless transmission, and selectively modify the portion of the video data provided to the display in response to receiving the signal.

In another embodiment, a portable optical device includes an optical sensor to capture video data of a view area, a display configured to display a portion of the video data, a transceiver configured to communicate data through a wireless communication channel, and a controller. The controller is configured to provide the portion of the video data and overlay data to the display, provide media data including the video data and the overlay data to the transceiver for communication through the wireless communication channel, receive a signal from the wireless communication channel in response to the media data, and selectively modify at least one of the overlay data and the portion of the video data in response to receiving the signal.

In still another embodiment, a method includes receiving media content from a gun scope at a computing device, providing the media content to a display of the computing device, receiving a user input corresponding to the media content at the computing device, and sending a signal to the portable optical device in response to receiving the user input.

In yet another embodiment, a computer-readable storage device includes computer-readable instructions that, when executed by a processor, cause the processor to receive media data from a firearm scope, provide the media data from the firearm scope to a display, receive a user input corresponding to the media data, and send a signal related to the user input to the firearm scope.

BRIEF DESCRIPTION OF THE DRAWINGS

In the following discussion, the same reference numbers are used in the various embodiments to indicate the same or similar elements.

DETAILED DESCRIPTION OF ILLUSTRATIVE EMBODIMENTS

In the following detailed description of the embodiments, reference is made to the accompanying drawings which form a part hereof, and in which are shown by way of illustration of specific embodiments. It is to be understood that other embodiments may be utilized and structural changes may be made without departing from the scope of the present disclosure.

Described below are embodiments of a portable optical device, such as a rifle scope, a telescope, binoculars, or other optical device that is configured to wirelessly communicate with a computing device. As used herein, the term "computing device" can refer to any electronic device configurable to couple to a communications network and to execute instructions, such as Internet browser applications, image rendering applications, and the like, and to receive user inputs, such as through interaction with a keypad or a touch-sensitive interface. The portable optical device may send media content to the computing device through a wireless communication link and may receive a signal in response thereto. As used herein, the term "media content" can include video data, audio data, text data, graphical data, processor-executable instructions, or any combination thereof. In an example, the portable optical device includes video capture (recording) functionality to capture video data associated with a view area, and includes a network transceiver. The portable optical device further includes data processing functionality configured to generate text data and graphical data (such as a reticle) and to present such data (as overlay data) together with at least a portion of the video data to a display. The portable optical device can be configured to communicate media content wirelessly to the computing device, and may be configured to adjust a visual display of the portable optical device in response to signals received from the computing device.

The computing device may be configured to run an application or process that displays media content from the portable optical device on a display. The display may be a touch-screen interface configured to accept inputs corresponding to the media content and to send a signal to the portable optical device based on the inputs. The signal includes data, such as commands, location data corresponding to a touch, or other data, which may be utilized by a controller of the portable optical device to adjust the portion of the video data provided to the display of the optical device and/or to adjust the overlay data.

As used herein, the term "portable" refers to a device that can be carried by a user. In a particular embodiment, the portable optical device may be implemented as a gun scope that can be mounted to a small arms firearm. One possible example of an embodiment of a portable optical device implemented as a rifle scope is described below with respect to FIG. 1.

Figure 1:
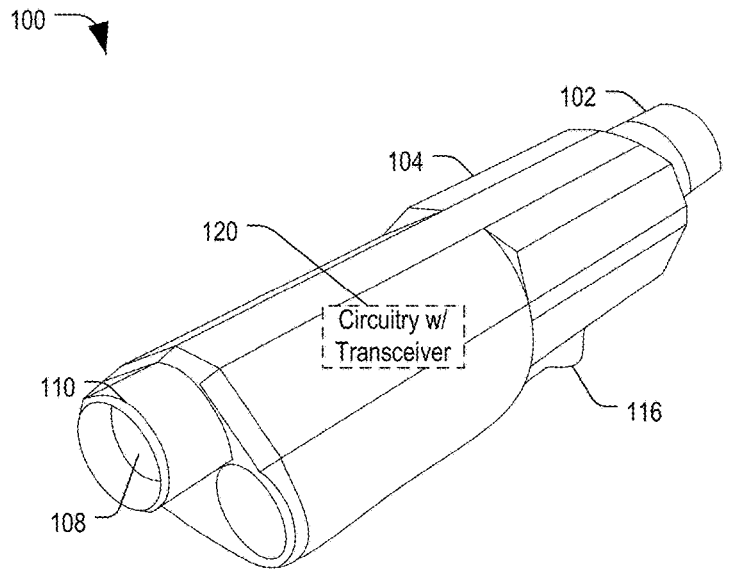
FIG. 1 is a perspective view of an embodiment of a rifle scope including circuitry for wireless control.

FIG. 1 is a perspective view of an embodiment of portable optical device with wireless control, which is implemented as a rifle scope 100 including circuitry 120 with a network transceiver. Rifle scope 100 can include an eyepiece 102 through which a user may look to see at least a portion of a view area. Rifle scope 100 may further include a housing 104 that defines an enclosure sized to secure circuitry and sensors configured to determine environmental parameters, to receive user inputs, to select a target (automatically or in response to user inputs), and to determine a range to the selected target. Housing 104 can also include optical sensors, optionally one or more mirrors, and image processing circuitry configurable to digitally magnify and process optical data captured by the optical sensors. Rifle scope 100 can further include an optical element 110 including a lens portion 108 for focusing light toward optical sensors associated with circuitry 120. Additionally, rifle scope 100 can include one or more ports 116 configurable to couple to an external device, such as a smart phone, laptop or tablet computer, or other computing device to transfer information and/or instructions, bi-directionally.

In an embodiment, circuitry 120 includes optical sensors configured to capture video data associated with a view area of rifle scope 100 received through optical element 110. Circuitry 120 further includes logic circuitry (such as a digital signal processor (DSP), a microprocessor unit (MCU), and/or communications logic) configured to format the captured video into a media content format suitable for transmission through a communication link to a computing device. The communication link can be a short-range wireless link (such as a Bluetooth® link) or a logical communications link through a network, such as a mobile phone network, a cellular, digital or satellite communication network, or another wireless communication network. The logical communications link may by any path or route through a network that communicatively couples the portable optical device to the computing device. In an example, rifle scope 100 sends the media content to a destination device. The destination device can be another optical device including another instance of circuitry 120, such as a spotting scope being used in conjunction with the rifle scope 100. In another embodiment, the destination device may be a computing device such as a desktop computer, laptop computer, tablet computing device, smart phone, or other device capable of executing instructions.

In an example, a user may attach rifle scope 100 to his/her rifle and carry the system into the field during a hunting expedition. When a user pulls the trigger, movement of the trigger is detected by circuitry 120 causing activation of the optical sensors to capture the video data. Detection of the trigger pull may further activate a microphone and audio processing circuitry to capture audio data. In other embodiments, circuitry 120 may be configured to continually capture optical and audio data for transmission.

In the above-example, rifle scope 100 is configured to capture and send media content, including video data and/or other data associated with a view area of rifle scope 100 to a destination device through the network, allowing the user to share video of his/her hunting experience with another user in real-time or near real-time.

The computing device may receive the media content and present the media content to a display together with one or more user-selectable options, such as buttons or links. A user may interact with the user-selectable options and/or the media content and, in response to the user interactions, the computing device may send a signal to the rifle scope 100, causing a controller within rifle scope 100 to selectively modify at least a portion of the video data and/or the overlay data provided to a display of rifle scope 100. For example, a user may interact with a touch-screen of the computing device to alter a zoom setting, and the signal sent from the computing device to the rifle scope 100 may cause the controller within the rifle scope 100 to adjust the view setting based on the signal. In another example, the media content from rifle scope 100 may represent real-time or near real-time video data corresponding to the portion of the view area provided to a display of the rifle scope. The user may touch a target within the media content via a touch-sensitive interface, causing the computing device to send the signal, and rifle scope 100 may alter the data provided to the display of rifle scope 100 to highlight or otherwise identify the selected target. One possible example of a system including a rifle scope in communication with a computing device is described below with respect to FIG. 2.

Figure 2:
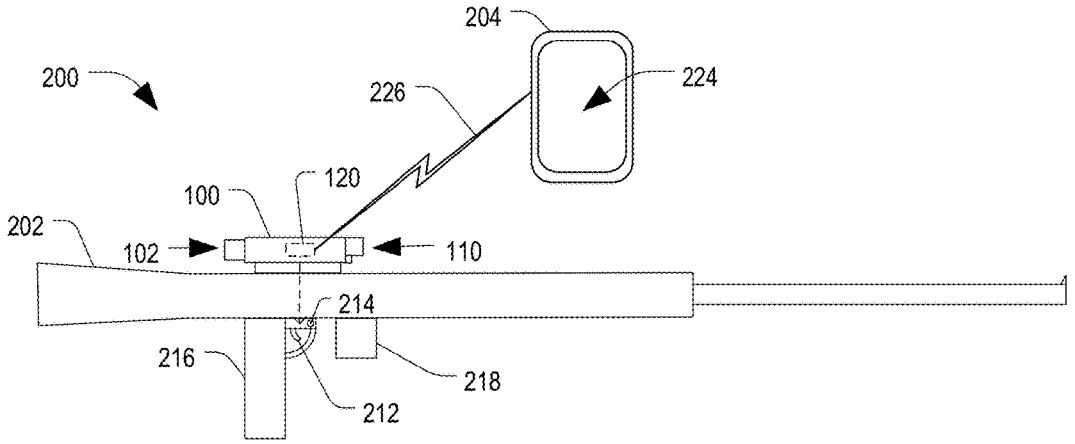
FIG. 2 is a side view of an example of a precision guided firearm system including a small arms firearm with a portable optical device including circuitry for wireless control.

FIG. 2 is a side-view of an embodiment of a system 200 including the rifle scope 100 of FIG. 1, and including a computing device 204 in communication with rifle scope 100. Firearm 200 includes rifle scope 100 that is mounted to a rifle 202 and that includes circuitry 120, eyepiece 102, and optical element 110. System 200 further includes a trigger shoe 212, a handle or grip 216, magazine 218, and one or more buttons, such as button 214, which can be coupled to an interface of rifle scope 100. In an embodiment, the user may interact with button 214 to initiate a target selection process, to select a target within the view area, to tag an object, or other interactions. In some embodiments, other buttons or other user interface elements may be located on the rifle scope 100 or rifle 202 to allow the user to manually perform one or more operations such as a zoom adjustment, a manual focusing adjustment, and the like.

Circuitry 120 of rifle scope 100 can be configured to wirelessly communicate with a computing device 204 via a communication link 226. As discussed above, the computing device may be a desktop computer, laptop computer, tablet computing device, smart phone, or other device including circuitry and software configured to communicate with circuitry 120, and to process and interact with media content received from the rifle scope 100. The computing device 204 can include a display component 224, which can be used to display media content received from the rifle scope 100. In an embodiment, display component 224 may be a touch-sensitive interface configured to display data and receive user input. As discussed above, the portion of the view data presented to the display of rifle scope 100 may be presented on display component 224, and the user may interact with display component 224, causing computing device 204 to send a signal to rifle scope 100 to selectively alter the portion of the video data and/or the overlay data provided to the display.

In an embodiment, a user may assist a shooter by observing the media content on display component 224 and by interacting with the display component 224 to provide feedback and/or instructions (or to alter the portion of the video data provided to a display of rifle scope 100), making it possible for a user to train and/or otherwise interact with the shooter in real time or near real-time. In an example, the user may be able to see the tag or visual marker on a selected target within the view area of the scope on display component 224 and to interact with the display component 224 to provide feedback to the shooter through rifle scope 100. An example of the communication between a portable optical device and a computing device is described below with respect to FIG. 3.

Figure 3:
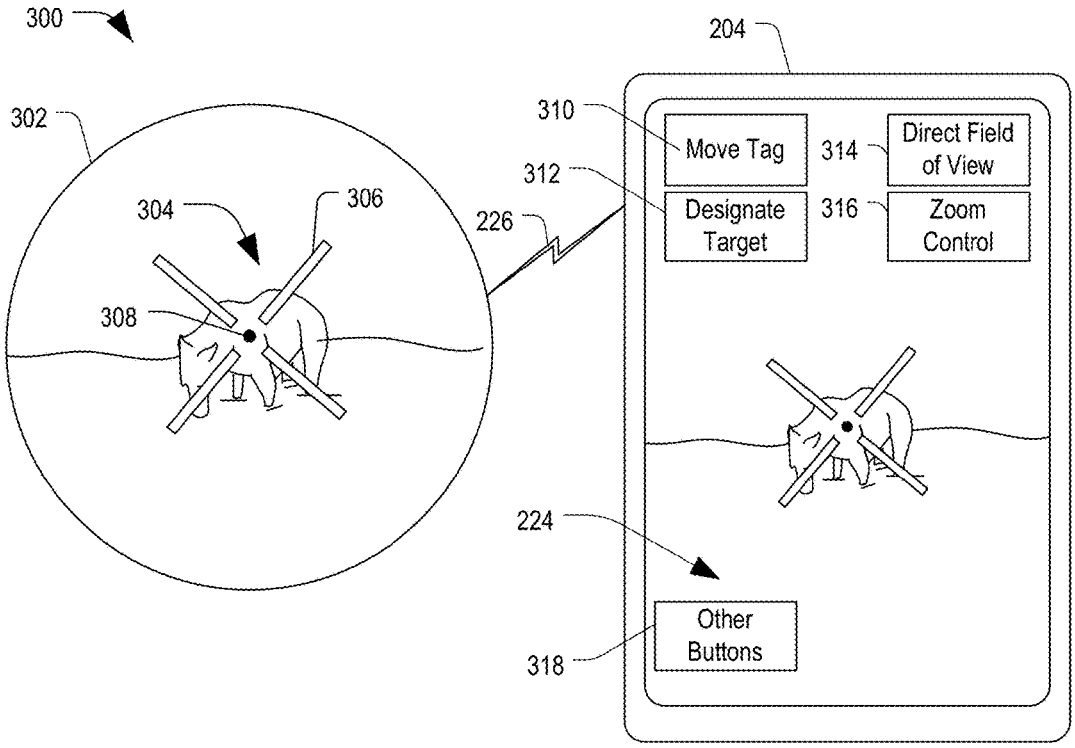
FIG. 3 is a representative example of a view area of a portable optical device including a selected target, and a computing device displaying the view area from the portable optical device.

FIG. 3 is a representative example 300 of a portion 302 of a view area of a portable optical device, such as the rifle scope 100 of FIGS. 1-2, including a selected target 304, and a computing device 204 displaying the portion of the view area from rifle scope 100. In an embodiment, rifle scope 100 sends the media content to the computing device 204, and the display component 224 may display the media content including the same portion 302 of the view area a shooter sees through eyepiece 102. In some embodiments, the computing device 204 may allow a user to adjust the viewing area, adjust the zoom, or modify other aspects of the data provided to the display of rifle scope 100 adjusting what a shooter sees in the eyepiece 102.

In an example, the optical element 110 captures video data associated with the view area in front of rifle scope 100. Circuitry 120 may provide a portion of the video data to the view area and may provide a reticle and other data for presentation within the display. When a shooter zooms in to a magnified portion of the view area, the optical element 110 may still be capturing optical data associated with a wider view area than what appears on the display. Circuitry 120 may send video data of the entire view area or just the portion of the view area to the computing device 204. In an example, the user may interact with the display component 224 to adjust the view area, such as by dragging the view area to the right or left (for example), causing the displayed portion within the rifle scope 100 to shift right or left. In an embodiment, a user may interact with the display component 224 to zoom in or pan the view shown on the display 224 to display different portions of the view area than what the shooter sees in the eyepiece 102. In some examples, the user may elect to view other portions of the view area without altering the portion of the view area provided to a display within rifle scope 100.

Other overlay data of the view area 302 may include environmental data such as temperature, wind speed and direction, barometric pressure, range to the selected target, muzzle velocity, and/or other data. For example, a rifle scope 100 may allow a shooter to "tag" a target, which may place a visual marker on a selected target. The scope 100 may send media data to computing device 204. The media content may include the portion 302 of the view area and the potential target 304, the crosshairs 306, and any tag or target designation 308 via transmission circuitry 120 using a wireless communication link 226. The media content may also include other overlay data. In an embodiment, the media content is presented on display interface 224 of computing device 204, allowing the user of computing device 204 to see what the shooter sees.

Computing device 204 may be configured to execute an application to process the media data received from rifle-scope 100. In an example embodiment, computing device 204 is a portable computing device such as a tablet computer or smartphone and including an input interface, such as a touch-screen. Computing device 204 may receive the media data and provide the media data to a display. Computing device 204 may then receive user input corresponding to the media data and may send a signal to rifle scope 100, which may cause rifle scope 100 to alter at least one of the portion of the video data provided to the display and the overlay data.

In the illustrated embodiment, in addition to the media content received from rifle scope 100, interactive options are shown on display element 224. For example, options may include a "Move Tag" button 310 accessible by a user to adjust a location of tag or visual marker 308 within the portion 302 of the video data. Additionally, display element 224 depicts a "Designate Target" button 312 accessible by a user to initiate a target identification process and to identify a target, such as by touching an area of the display element 224 corresponding to a location of the target within the displayed media content. The options further include a "Direct Field of View" button 314 that, when selected, allows the user to drag, scroll or otherwise change the portion of the view area presented to a display of rifle scope 100. Alternatively, the "Direct Field of View" button 314 may be selected to place an arrow or other directional indication within the portion of the view area to direct the shooter to change the view area in the direction of the pointer. The options also include a "Zoom Control" button 316 that, when executed, allows the user to selectively alter the level of zoom of rifle scope 100. In an example, the user may touch the touch-screen and pinch or expand the view area to zoom in or zoom out. In another example, zoom in and zoom out buttons may be presented that user may select to alter the zoom level. The options may include other buttons 318 as well. In some instances, the user may simply tap or otherwise interact with display component 224 to access user-selectable features. User interactions with display component 224 are treated as user input and can be transmitted as a signal to rifle scope 100 to selectively alter the overlay data and/or the portion of the view area presented to a shooter.

In a particular example, when the user selects the "Move Tag" button 310, computing device 204 may allow a user to move a position of visual marker or tag 308 to adjust the selected location on the target. For example, a shooter may tag a target 304 using a digital rifle scope 100, and a trainer using the computing device 204 may want to relocate the tag indicate a better location on the selected target. Thus, the communication between computing device 204 and rifle scope 100 may be used to facilitate training.

Some embodiments may have additional interactive options, as represented by the "other buttons" 318 element, and some embodiments may have fewer buttons. In an example embodiment using a touchscreen interface, interface buttons 310-318 may not be needed, and commands can be entered by means of specific touch feedback commands; e.g. double-tapping may place a tag, while pressing down and dragging in a direction may adjust the field of view. In some embodiments, a user may input commands to the computing device 204 by means of a pointer device such as a mouse or stylus, by means of a touchscreen interface as discussed, by voice commands, or by other means.

User inputs received at the computing device may be converted into a signal appropriate for transmission over wireless communication link 226, and transmitted to rifle scope 100. Circuitry 120 in rifle scope 100 may process the signal and place or move tags, adjust the field of view, or make other modifications to the image provided to a display of rifle scope 100. For example, a shooter may see a new target designation through the eyepiece 102 of a rifle scope 100.

Figure 4:
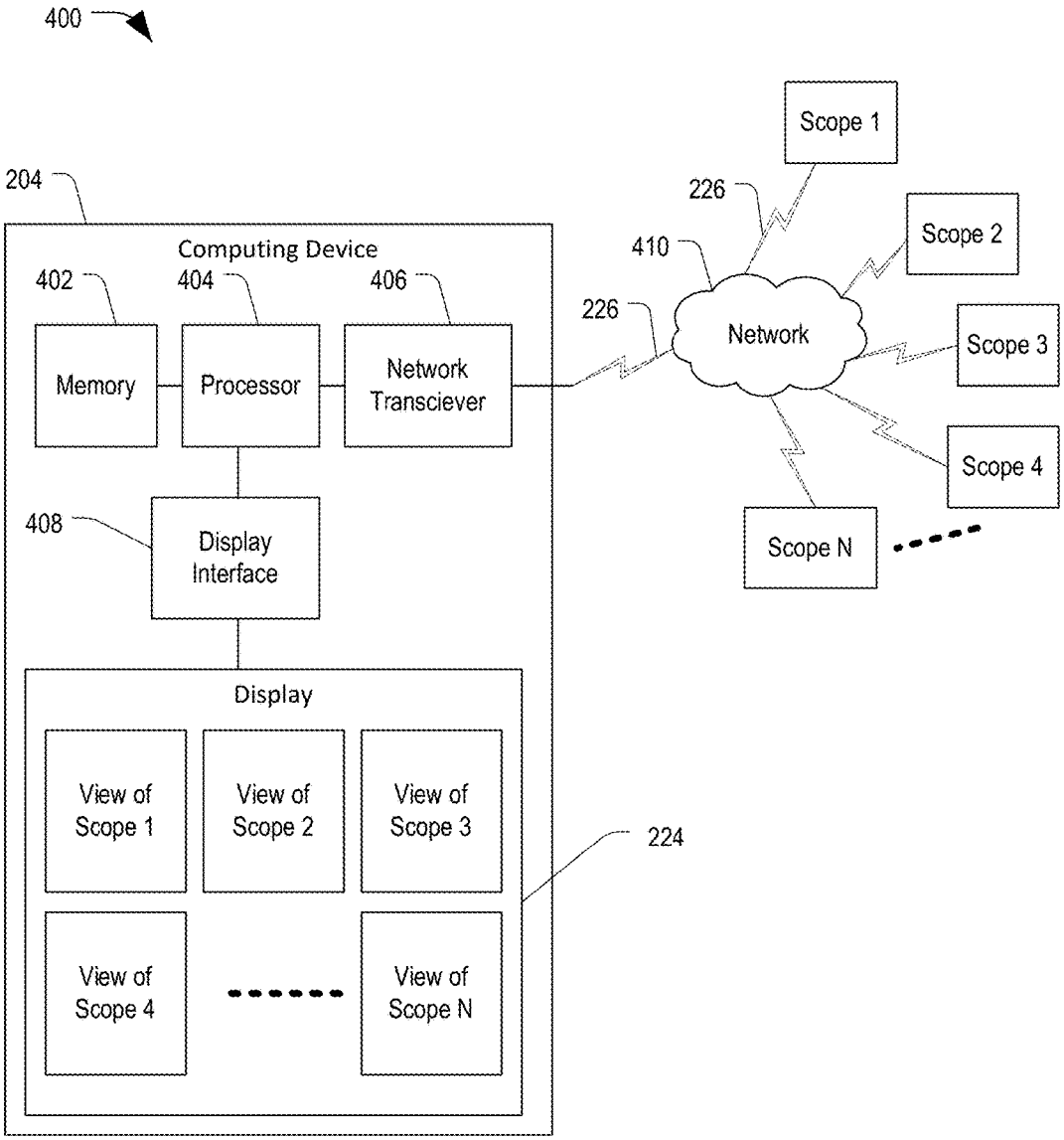
FIG. 4 is an example block diagram of a system including a computing device displaying views from a plurality of portable optical devices.

FIG. 4 depicts a block diagram of an embodiment of a system 400 including computing device 204 including views from a plurality of portable optical devices, such as rifle scope 100. The computing device 204 may include a processor 404, memory 402 coupled to processor 404, and a network transceiver 406 coupled to processor 404. Computing device 204 may further include a display interface 408, and display component 224 as shown in FIGS. 2-3. As discussed above, display component 224 may include a touch-sensitive interface for receiving user input. Memory 402 may include one or more data storage media, and may be any form of volatile or nonvolatile memory, such as EEPROM, disc memory, or DRAM. In one embodiment, memory 402 may comprise a computer-readable storage device which stores computer-readable instructions executable by the processor 404. Processor 404 may load an application from the memory 402 for communicating with and remotely interacting with media data from a portable optical device, such as rifle scope 100 in FIGS. 1-3.

In an embodiment, the computing device 204 is configured to communicate with a plurality of portable optical devices, shown as Scope 1 through Scope N. Scope 1 through Scope N may communicate media data via a wireless communication links, such as wireless communication link 226 to a network 410, such as the Internet, a short-range communication network, a cellular, digital, or satellite network, a secure private network, other networks, or any combination thereof. The computing device 204 may communicate with the network 410 using a network transceiver 406 to receive media data from each of the scopes 1 through N and to present the media data to portions of display component 224.

In an embodiment with multiple portable optical devices, such as the N scopes, computing device 204 can present media data from each of the scopes 1-N on the display 224, simultaneously. In one embodiment, a single instructor can utilize display component 224 to monitor multiple shooter students. In another embodiment, a user may interact with the display component 224 to generate a signal to selected ones of the scopes. In a particular embodiment, a spotter may utilize the views to designate targets for the users of each of the scopes, and the computing device 204 may communicate a signal to selected ones of the scopes to communicate the target designation information.

As described herein, the computing device 204 can accept user input in response to the presented media content from portable optical devices. A user of computing device 204 may be able to selectively provide user input corresponding to the media data from one of the plurality of scopes 1 to N, for example. The processor 404 can selectively transmit signals corresponding to the user inputs through the network 410 via the network transceiver 406 to a designated one of the scopes. When a user enters input in response to selected media data, the processor 404 can selectively transmit a signal to the scope corresponding to the selected video feed. In some embodiments, a user may wish to provide inputs to all connected optical devices, such as to display a message on the optical device display, which inputs can be transmitted to all of the scopes in a multi-cast type of transmission. The processor may also be configured to store recordings of the media content received or user inputs to the memory 402 to maintain a record.

Figure 5A:
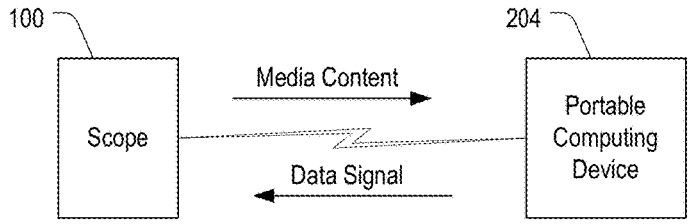
FIGS. 5A-5D are block diagrams including examples of wireless connectivity configurations between a portable optical device and one or more computing device(s).

FIGS. 5A-5D display a number of example arrangements of portable optical devices (such as rifle scope 100) and computing devices, such as computing device 204. FIG. 5A depicts a one-to-one bidirectional connection, for example where a single firearm scope 100 is configured to communicate with a single portable computing device 204 through a wireless communication link that facilitates a bi-direction communication path.

Figure 5B:
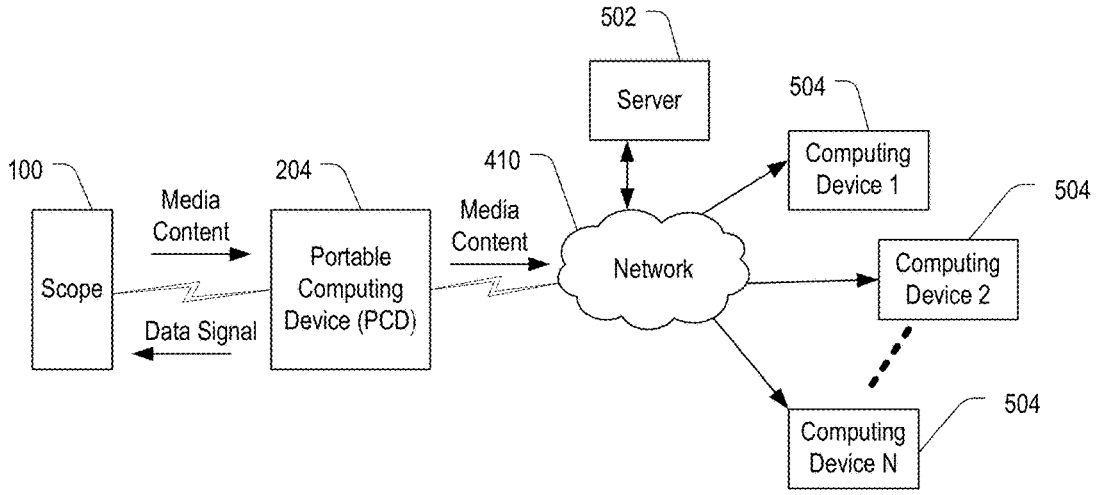

FIG. 5B depicts a one-to-many multicast arrangement in which rifle scope 100 may communicate media data to a portable computing device 204, such as a smart phone, which may allow a user to provide user input that may be sent as a signal to scope 100 to selectively alter the portion of the video data provided to the display. Further, portable computing device 204 may be configured to send media content to other computing devices, such as computing devices 504 through network and/or to a server 502 for a multi-cast transmission.

Figure 5C:
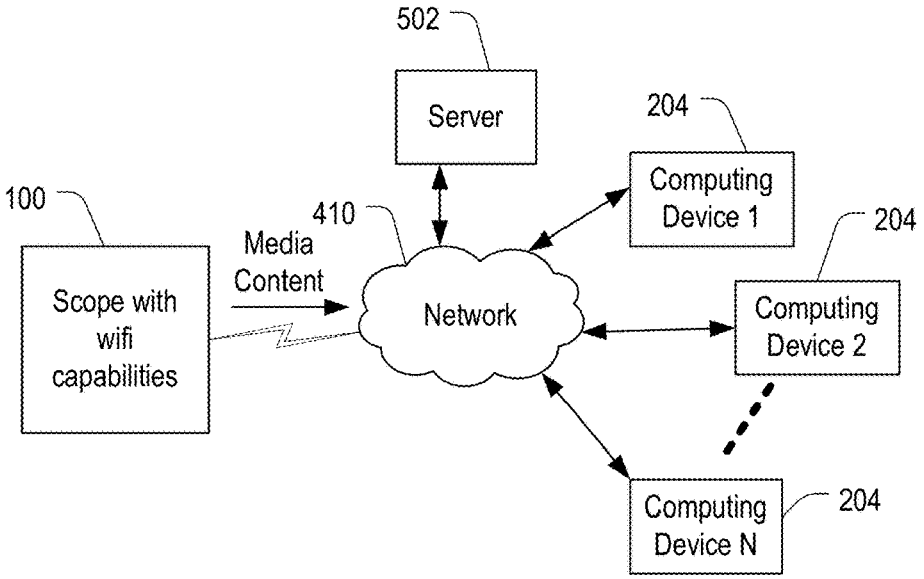

FIG. 5C depicts another one-to-many multicast arrangement. In the embodiment of FIG. 5C, the rifle scope 100 includes wireless transmission capabilities for coupling to network 410 and for sending media content to server 502, which may publish and/or re-broadcast the media content to computing devices 204 through network 410.

Figure 5D:
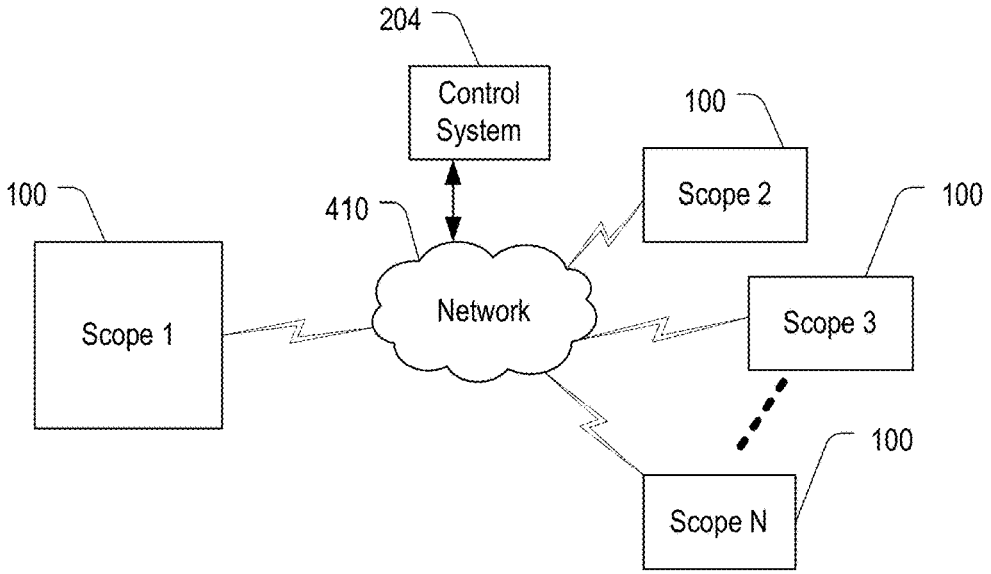

FIG. 5D depicts an arrangement where a plurality of firearm scopes 100 are connected via a network 410 to computing device 204, as described with respect to the system 400 of FIG. 4. In this embodiment, computing device 204 may simultaneously receive media content from a plurality of scopes 100 through network 410 and simultaneously display the media content from one or more of the scopes on a display component 224. A user of the computing device 204 may selectively send user inputs to one or more of the scopes 100 via the network 410.

Figure 6:
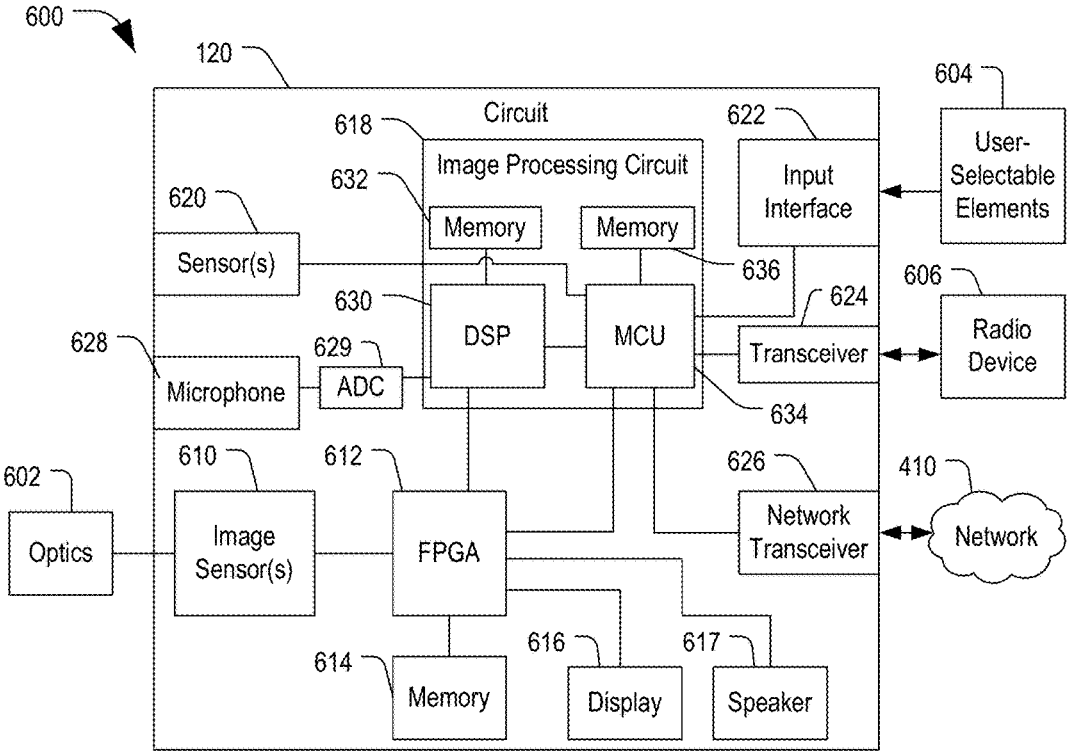
FIG. 6 is a block diagram of components of the portable optical device of FIGS. 1-3.

FIG. 6 is a block diagram of an example system 600 including the circuitry 120 of FIGS. 1-2. System 600 can include optics 602 configured to direct light toward image (optical) sensors 610 of circuitry 120. System 600 can further include user-selectable elements 604 (such as button(s) 214 in FIG. 2) coupled to an input interface 622 of circuitry 120. System 600 may also include a radio device 606 (such as a hand-held radio frequency (RF) communications device, a portable base station, or another electronic device capable of communicating with a network 410) that is coupled to network transceiver 626 through a wired or wireless communications link. In an example, radio device 606 may be an example of a portable computing device 204 including a short-range or long-range wireless transceiver. System 600 can be coupled to network 410 through a network transceiver 626 or through such a portable computing device. In an example, circuitry 120 can communicate bi-directionally with network 410 through network transceiver 626 or can communicate bi-directionally with radio device 606, which is configured to couple to network 410 and to facilitate communication between circuitry 120 and network 410.

Circuitry 120 can include a field programmable gate array (FPGA) 612 including one or more inputs coupled to outputs of image (optical) sensors 610. FPGA 612 may further include an input/output interface coupled to a memory 614, which can store data and instructions. FPGA 612 can include a first output coupled to a display 616 for displaying images and/or text and a second output coupled to a speaker 617. FPGA 612 may also be coupled to a digital signal processor (DSP) 630 and a micro controller unit (MCU) 634 of an image processing circuit 618. Circuitry 120 can also include sensors 620 configured to measure one or more environmental parameters (such as wind speed and direction, humidity, temperature, and other environmental parameters) and/or to measure optical elements, such as reflected laser range finding data, and to provide the measurement data to MCU 634. Circuitry 120 can further include a microphone 628 to capture sounds and to convert the sounds into an electrical signal, which it can provide to an analog-to-digital converter (ADC) 629. ADC 629 may include an output coupled to an input of DSP 630. In some embodiments, the microphone 628 may be external to circuitry 120 and circuitry 120 may instead include an audio input jack or interface for receiving an electrical signal from microphone 628. In a particular example, the speaker 617 and microphone 628 may be incorporated in a headset worn by a user that is coupled to circuitry 120 through an input/output interface (not shown).

DSP 630 can be coupled to a memory 632 and to MCU 634. MCU 634 may be coupled to a memory 636. MCU 634 can also be coupled to input interface 622, transceiver 624, and network transceiver 626. In an example, transceiver 624 can be part of an input/output interface, such as a Universal Serial Bus (USB) interface or another wired (or wireless) interface for communicating data to and receiving data from radio device 606, which may be configured to communicate bi-directionally with network 410. In a particular example, transceiver 624 is a wireless transceiver for communicating data to and receiving data from radio device 606. Network transceiver 626 can communicate media content to network 410 and receive data and/or media content from network 410. In an example, network 410 can be a communications network, such as the Internet, a wireless telephone network (cellular, digital, or satellite), an ad hoc wireless network, or any combination thereof. In a particular example, circuitry 120 may receive audio data from network 410 and output the audio data to a user through speaker 617 and may send audio data from microphone 628 through network 410, allowing the user to utilize circuitry 120 for full-duplex or half-duplex audio communication. Further, circuitry 120 can communicate media content, such as video and audio of a view area to a destination device through network 410, and receive signals through network 410 reflecting user input with regard to media data transferred over the network 410 to a computing device.

In an example, DSP 630 executes instructions stored in memory 632 to process audio data from microphone 628. MCU 634 processes instructions and settings data stored in memory 636 and is configured to control operation of circuitry 120. FPGA 612 is configured to process image data from image (optical) sensors 610. FPGA 612 processes the image data to enhance image quality through digital focusing and gain control. Further, FPGA 612 can perform image registration and stabilization. FPGA 612 may cooperate with DSP 630 to perform optical target tracking within the view area of the portable optical device that incorporates circuitry 120. FPGA 612 further cooperates with MCU 634 to mix the video data with overlay data, such reticle information and target tracking information (from DSP 630) and provides the resulting image data to display 616. As a target moves within the view area, DSP 630 can perform target tracking and can apply a visual marker to the target as shown on display 616. The FPGA 612, DSP 630 and MCU 634 can cooperate to modify a portion of the media content sent to the display 616 based on signals received over the network 410 corresponding to user inputs related to the media content.

User-selectable (adjustable) elements 604 may allow the user to control circuitry 120 to transmit media content to a destination device through network 410. Thus, the user can share captured video data, audio data, text data, graphical data, or any combination thereof with a remote user through network 410. If circuitry 120 is incorporated in a rifle scope, such as rifle scope 100, the shooter can capture and transmit media content of his/her hunting experience in real-time or near real-time, and receive signals representing user feedback through the network 410. Signals received through the network 410 can be processed by circuitry 120 and influence a portion of media content displayed on display 616.

In an example where circuitry 120 is incorporated in a rifle scope or optical scope, circuitry 120 can communicate directly with network 410 or can communicate indirectly with network 410 through an intermediate device, such as radio device 606. In some instances, radio device 606 can be configured to communicate directly with other radio devices, forming an ad hoc wireless network or secure network (such as a battlefield network). In one example, circuitry 120 transmits location data, image data, and other information to such radio devices, which information is shared with one or more other radio devices coupled to the ad hoc wireless network or battlefield network.

While the example of FIG. 6 depicted some components of circuitry 120, at least some of the operations of circuitry 120 may be controlled using programmable instructions. In one instance, such instructions may be upgraded and/or replaced using transceiver 624. In one instance, the replacement instructions may be downloaded to a portable storage device, such as a thumb drive or radio device 606, which may then be coupled to transceiver 624. The user may then select and execute the upgrade instructions by interacting with the user-selectable elements 604.

Figure 7:
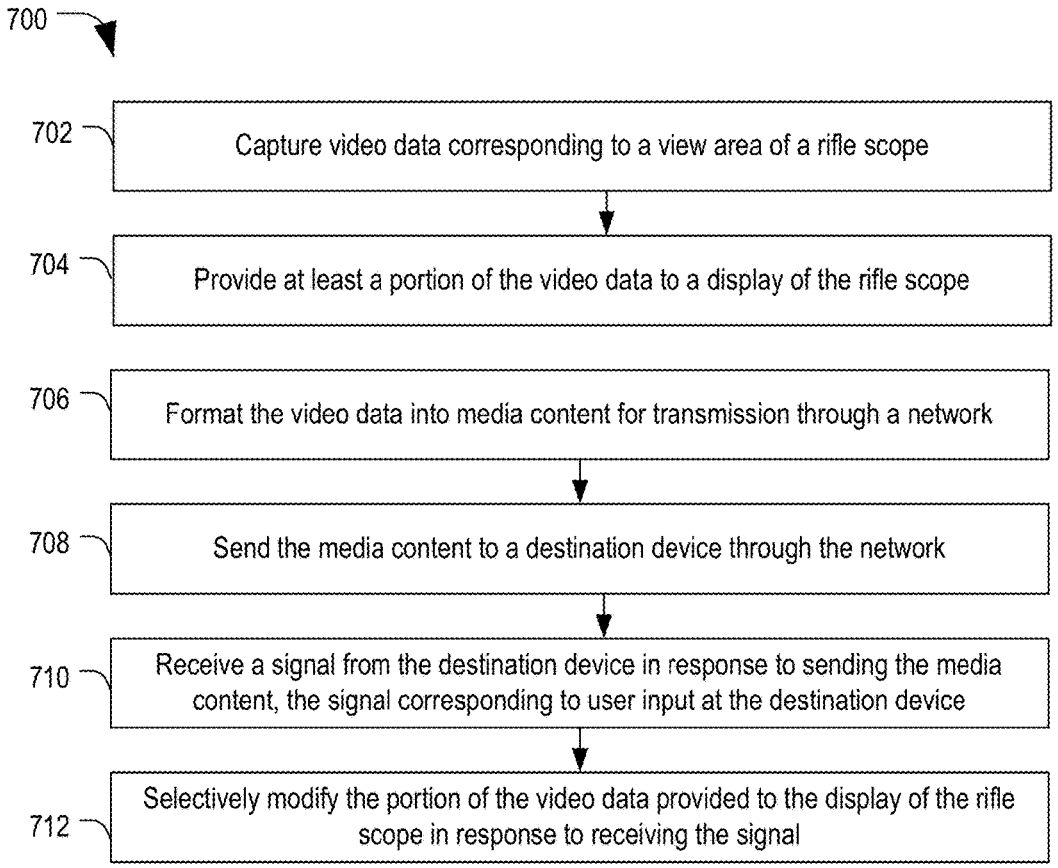
FIG. 7 is a flow diagram of an embodiment of a method of wirelessly controlling a portable optical device.

FIG. 7 is a flow diagram of an embodiment of a method 700 of wirelessly controlling a portable optical device. At 702, circuitry 120 captures video data corresponding to a view area of a rifle scope 100. Moving to 704, DSP 630 and FPGA 612 provide at least a portion of the video data to display 616 of the rifle scope 100. For example, the display 616 may show a zoomed-in view that only displays a portion of the video data. Advancing to 706, MCU 634 formats the video data into media content for transmission through a network, such as communications network 410. In an example, MCU 634 formats the video data into media content packets for transmission via a TCP/IP network through a direct wireless connection between circuitry 120 and network 410. Continuing to 708, MCU 634 controls network transceiver 626 (or transceiver 624 and radio device 606) to send the media content to a destination device through the network 410. The media content may include video data corresponding to the view area and may also include audio data, environmental data, or graphical overlay data, for example. In an example embodiment, the media content may be formatted and transmitted to a computing device 204 through a wired or wireless connection, and computing device 204 can send the media content and/or receive media content to and from other devices or other circuitry through network 410, as shown in FIG. 5B.

Proceeding to 710, circuitry 120 receives a signal from the destination device in response to sending the media content, the signal corresponding to user input at the destination device. For example, circuitry 120 may receive a signal in response to a user tagging a target depicted in the video data at the destination device. In another example, circuitry 120 may receive zoom data and/or a target designation signal from the destination device. Advancing to 712, circuitry 120 selectively modifies the portion of the video data provided to the display 616 of the rifle scope 100 in response to receiving the signal. For example, the target tagged by the user at the destination device may now be tagged in the portion of the video data shown in the display 616.

Figure 8:
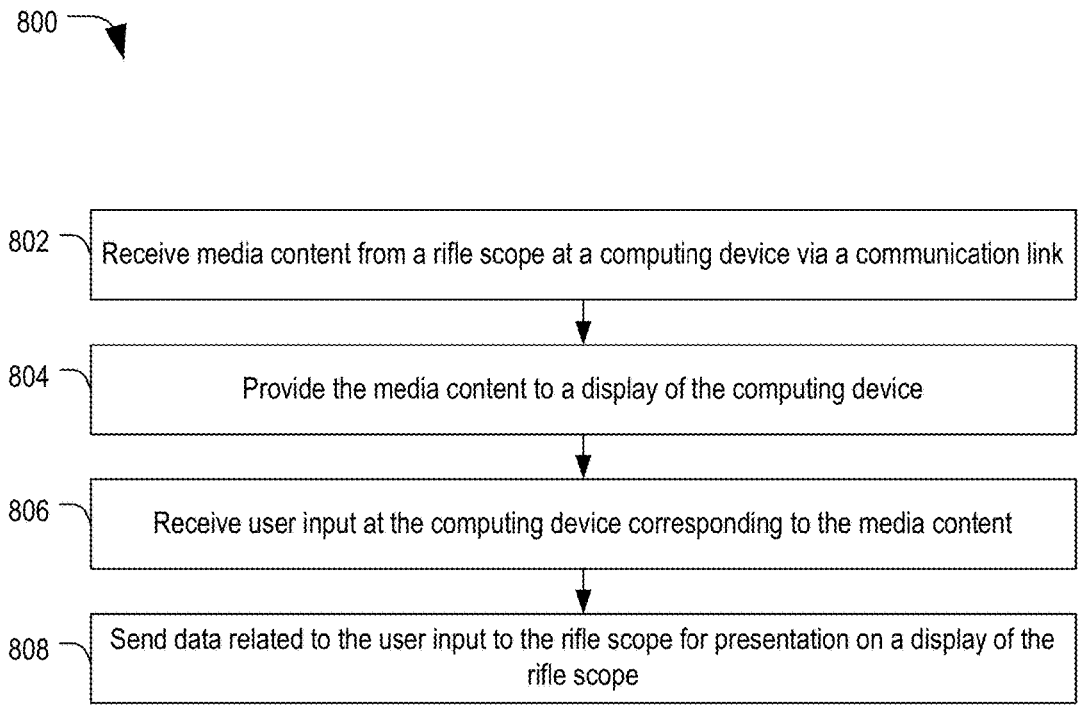
FIG. 8 is a flow diagram of another embodiment of a method of wirelessly controlling a portable optical device.

FIG. 8 is a flow diagram of another embodiment of a method 800 of wirelessly controlling a portable optical device. At 802, the method 800 involves receiving media content from a rifle scope 100 at a computing device 204 via a communication link, such as wireless communication link 226 or network 410. Advancing to 804, a processor 404 provides the media content to a display 224 of the computing device 204. The media content may include video data, audio data, text data, environmental data, graphical overlay data, other information, or any combination thereof. Moving to 806, the method 800 includes receiving user input at the computing device 204 corresponding to the media content. In some examples, the user input may involve user-interaction with a touch-sensitive interface or other input mechanism to adjust a view area, set a zoom level, adjust a set tag, designate a target, control other functions, or any combination thereof. Proceeding to 808, the computing device 204 sends data related to the user input to the rifle scope 100 for presentation on a display 616 of the rifle scope 100. For example, the data related to the user input may cause the portion of video data presented on the screen 616 to zoom in and display a new target designation based on user input. Alternatively, the data or signal provided to the rifle scope may cause the rifle scope to place an arrow or other visual indicator on the display to direct the user to change the orientation of the rifle scope.

Although the above methods are directed towards a computing device and a rifle scope, the teachings can be applied to telescopes, binoculars, or other portable optical devices. Similarly, steps of the methods may be performed by other device elements than described, or some elements may be combined or eliminated without departing from the scope of the present disclosure.

In accordance with another embodiment, the methods described herein may be implemented as one or more software programs running on a computing device, such as a personal computer, telephone, tablet, or other device. Dedicated hardware implementations including, but not limited to, application specific integrated circuits, programmable logic arrays, and other hardware devices can likewise be constructed to implement the methods described herein. Further, the methods described herein may be implemented as a computer readable storage medium including instructions that, when executed, cause a processor to perform the methods.

While the present invention has been described with reference to particular embodiments, workers skilled in the art will recognize that changes may be made in form and detail without departing from the scope of the disclosure.

What is claimed is:

1. A firearm scope comprising:

an optical sensor to capture video data;

a display;

a transceiver configured to communicate data wirelessly through a communication channel; and a controller configured to:

provide a portion of the video data to the display;

provide media content including the video data, a reticle, and a visual marker assigned by a user of the firearm scope to a selected location on a selected target within the video data to the transceiver for wireless transmission;

maintain the visual marker on the selected location on the selected target by automatically tracking the selected target within the video data;

receive a signal from the communication channel in response to the wireless transmission, the signal from a computing device operated by a remote user; and selectively modify the portion by adjusting the selected location of the visual marker previously assigned by the user on the selected target within the portion of the video data provided to the display in response to receiving the signal to reposition the visual marker.

2. The firearm scope of claim 1, wherein the portion of the video data includes overlay data, and wherein the media content provided to the transceiver includes the overlay data.

3. The firearm scope of claim 1, wherein the signal includes a designation of a target within the video data, and wherein the controller selectively modifies the portion of the video data to highlight the target in response to receiving the signal.

4. The firearm scope of claim 1, wherein the signal includes a view adjustment, and wherein the controller selectively modifies the portion of the video data in response to the view adjustment.

5. The firearm scope of claim 4, wherein the view adjustment comprises at least one of a zoom setting and a view change signal designating a new portion of a view area of the optical sensor for presentation to the display.

6. The firearm scope of claim 1, wherein the controller is configured to:

apply the visual marker on a selected location of the selected target in the display;

receive an adjustment signal from the communication channel; and adjust the selected location of the visual marker on the target in response to receiving the adjustment signal.

7. A portable optical device comprising:

an optical sensor to capture video data of a view area;

a display configured to display a portion of the video data;

a transceiver configured to communicate data through a wireless communication channel; and a controller configured to:

receive an input from a user of the portable optical device to assign a visual marker to a selected location on a selected target within the view area;

provide the portion of the video data and overlay data including a reticle and the visual marker applied to the selected location on the selected target to the display;

provide media data including the video data and the overlay data including the visual marker to the transceiver for communication through the wireless communication channel;

maintain the visual marker on the selected location on the selected target by automatically tracking the selected target within the video data;

receive a signal from the wireless communication channel in response to communication of the media data, the signal from a computing device operated by a remote user; and selectively modify at least one of the overlay data and the portion of the video data in response to receiving the signal to adjust the selected location of the visual marker previously assigned by the user to the selected target to reposition the visual marker according to the signal from the remote user.

8. The portable optical device of claim 7, wherein the overlay data includes a reticle, the visual marker, and view data.

9. The portable optical device of claim 8, wherein the view data includes at least one of a temperature, a range to a target, an incline parameter, a wind parameter, a barometric pressure, a muzzle velocity, and a scope operating mode indicator.

10. The portable optical device of claim 7, wherein the transceiver is configured to send and receive data to and from a computing device through the wireless communication channel.

11. The portable optical device of claim 7, wherein the controller adjusts the portion of the video data to adjust a location of the visual marker on the selected target in response to the signal.

12. The portable optical device of claim 7, wherein the media data is sent to a computing device through the wireless communication channel for multi-cast transmission to a plurality of computing devices.

13. The portable optical device of claim 7, wherein the controller is configured to modify the overlay data provided to the display based on the signal by adjusting the visual marker within the portion.

14. The portable optical device of claim 7, wherein the controller is configured to modify the portion of the video data provided to the display based on the signal by adjusting a field of view to define a new portion of the video data.

15. A method comprising:

receiving media content including a reticle and including a tag corresponding to a selected location on a target from a gun scope at a computing device, the selected location selected by a user of the gun scope;

providing the media content to a display of the computing device;

automatically maintaining the visual marker on the selected location on the selected target within the video data;

receiving a user input corresponding to the media content at the computing device, the user input indicating an adjustment of a location of the tag within the media content; and sending a signal to the gun scope in response to receiving the user input to adjust the location of the tag within a portion of the media content displayed within the gun scope to reposition the tag to another location that differs from the selected location selected by the user of the gun scope.

16. The method of claim 15, wherein the media content includes an approximately real-time video feed from the gun scope.

17. The method of claim 15, wherein the signal includes at least one of a field of view adjustment, a zoom adjustment, a target designation, and a tag location setting configured to initiate an operation within the gun scope.

18. The method of claim 15, further comprising:

receiving media content from multiple gun scopes substantially concurrently at a computing device;

receiving a user input at the computing device; and selectively sending a target designation signal corresponding to the user input to a selected one of the multiple gun scopes to designate a selected target.

19. A computer-readable storage device comprising computer-readable instructions that, when executed by a processor, cause the processor to:

receive media data from a firearm scope, the media data including a video feed and a visual marker corresponding to a location of a selected target within the video feed, the location of the visual marker selected by a user of the firearm scope, the media data further including a reticle;

provide the media data to a display;

maintain the visual marker on the selected location on the selected target by automatically tracking the selected target within the video data;

receive a user input corresponding to the media data; and send a signal related to the user input to the firearm scope, the signal configured to adjust the location of the visual marker at a display of the firearm scope from the location of the visual marker selected by the user of the firearm scope to another location.

20. The computer-readable storage device of claim 19, wherein the user input includes a field of view adjustment input and wherein the signal sent to the firearm display includes a field of view control signal configured to alter a field of view within the firearm scope.

21. The computer-readable storage device of claim 19, wherein the instructions further include instructions that, when executed, cause the processor to:

receive media data from multiple firearm scopes simultaneously;

present to the display the media data from a selected one or more of the multiple firearm scopes simultaneously;

receive the user input corresponding to the media data of one of the multiple firearm scopes; and send the signal to the one of the multiple firearm scopes in response to receiving the user input.

* * * * *